US008350450B2

(12) United States Patent
Tsao et al.

(10) Patent No.: US 8,350,450 B2
(45) Date of Patent: Jan. 8, 2013

(54) LED LAMP

(75) Inventors: Chih-Chung Tsao, Miao-Li Hsien (TW); Chih-Ming Lai, Miao-Li Hsien (TW); Yu-Pin Liu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 73 days.

(21) Appl. No.: 12/749,472

(22) Filed: Mar. 29, 2010

(65) Prior Publication Data

US 2011/0074267 A1 Mar. 31, 2011

(30) Foreign Application Priority Data

Sep. 30, 2009 (CN) ..... 2009 1 0308016

(51) Int. Cl.
*H01J 61/42* (2006.01)

(52) U.S. Cl. ..... 313/46

(58) Field of Classification Search ..... 313/46
See application file for complete search history.

(56) References Cited

U.S. PATENT DOCUMENTS

| | | | | |
|---|---|---|---|---|
| 6,659,632 | B2 * | 12/2003 | Chen | 362/545 |
| 2006/0198147 | A1 * | 9/2006 | Ge | 362/294 |
| 2007/0296350 | A1 * | 12/2007 | Maxik et al. | 315/291 |
| 2009/0116251 | A1 | 5/2009 | Harbers et al. | |

FOREIGN PATENT DOCUMENTS

| | | | |
|---|---|---|---|
| CN | 2859196 | Y | 1/2007 |
| CN | 101078477 | A | 11/2007 |
| CN | 201045474 | Y | 4/2008 |
| CN | 100485926 | C | 5/2009 |
| CN | 201310789 | Y | 9/2009 |
| CN | 101691921 | A | 4/2010 |
| TW | 200925505 | A | 6/2009 |
| WO | WO2008085017 | A1 | 7/2008 |
| WO | WO2009005285 | A2 | 1/2009 |

* cited by examiner

*Primary Examiner* — Anh Mai
*Assistant Examiner* — Brenitra M Lee
(74) *Attorney, Agent, or Firm* — Altis Law Group, Inc.

(57) ABSTRACT

An LED lamp includes a heat sink including a base having a heat-dissipating face, an LED module including a printed circuit board mounted on the base and a plurality of LEDs disposed on the printed circuit board, and a connecter electrically connecting the LED module to a power supply. The heat sink further includes a plurality of spiral fins protruding outwardly from the heat-dissipating face of the base.

16 Claims, 11 Drawing Sheets

LED LAMP

BACKGROUND

1. Technical Field

The disclosure relates to LED (light emitting diode) lamps for illumination purpose and, more particularly, relates to an improved LED lamp having a good heat dissipation.

2. Description of Related Art

An LED lamp is a type of solid-state lighting that utilizes LEDs as a source of illumination. An LED is a device for transferring electricity into light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

An LED lamp generally requires a plurality of LEDs driven at the same time, which results in a rapid rise in operating temperature of the LEDs. However, since the lamp lacks an effective heat dissipation means, continuous operation of the LED lamp can cause the light emitted from the LEDs thereof to flicker.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
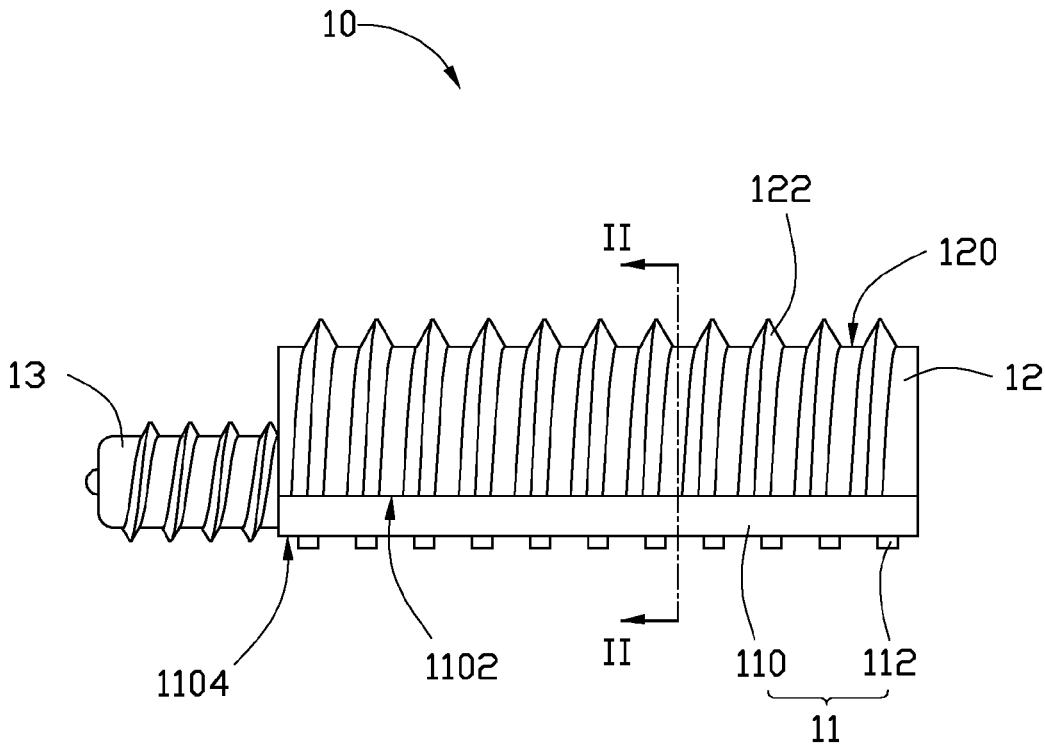
FIG. 1 is an elevation view of an LED lamp in accordance with a first embodiment of the disclosure.
Figure 2:
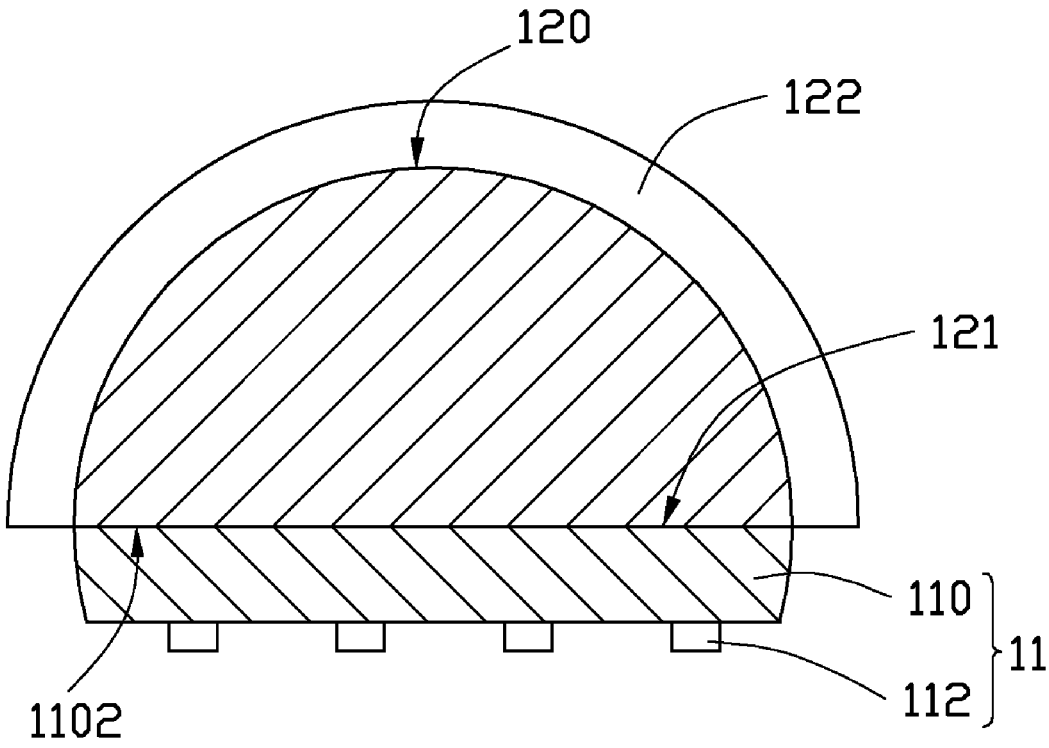
FIG. 2 is a cross-sectional view of the LED lamp of FIG. 1, taken along line II-II thereof.

Referring to FIGS. 1 and 2, a light emitting diode (LED) lamp in accordance with a first embodiment of the disclosure is illustrated. The LED lamp comprises a heat sink 10, an LED module 11 thermally attached to the heat sink 10, and a connecter 13 extending outwardly from a lateral side of the heat sink 10.

The heat sink 10 is integrally made of a metal with good heat conductivity such as aluminum, copper or an alloy thereof. The heat sink 10 comprises a base 12 and a plurality of fins 122 extending outwardly from the base 12. The base 12 has a semicircular cross section, and defines a planar first face 121 and a curved second face 120 at an outer circumference of the heat sink 12. The LED module 11 is attached on the planar first face 121 of the base 12. The fins 122 are arranged on the curved second face 120 of the base 12 and spaced from each other. The fins 122 extend spirally along an axis of the base 12, acting as threads around the base 12.

The LED module 11 comprises a printed circuit board 110 and a plurality of LEDs 112 mounted on the printed circuit board 110. The printed circuit board 110 defines a first engaging face 1102 and a second engaging face 1104. The first engaging face 1102 is correspondingly attached to the first face 121 of the base 12. The LEDs 112 are evenly arranged on the second engaging face 1104. In the first embodiment of this disclosure, the printed circuit board 110 is plate-shaped, and the first and second engaging faces 1102, 1104 of the printed circuit board 110 are both planar faces and parallel to each other.

The connecter 13 extends outwardly from an end of the base 12 of the heat sink 10 for electrically connecting the LED module 11 to a power supply. The connecter 13 is screwedly engaged with the power supply by a plurality of threads formed on an outer circumference of the connecter 13. A pitch of the threads of the connecter 13 is equal to that of the fins 122 of the heat sink 10.

Figure 3:
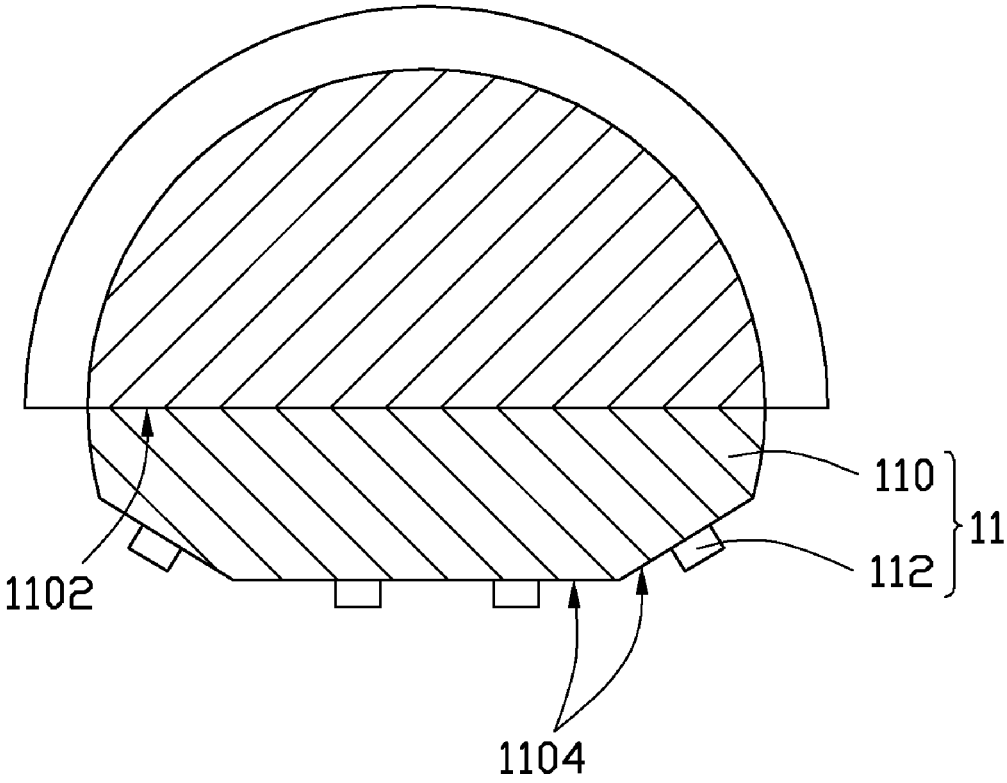
FIG. 3 shows a cross section of an LED lamp of a second embodiment of the disclosure.

Referring to FIG. 3 also, an LED lamp of a second embodiment is shown. Difference between the LED lamps of the first and the second embodiments is a profile of the second engaging face 1104 of the printed circuit board 110. In the second embodiment of this disclosure, the printed circuit board 110 has a configuration like a pentagonal prism, and the second engaging face 1104 consists of three planar faces which are inclined to each other, whereby light emitted by the LEDs 112 which are mounted on the three planar faces of the second engaging face 1104 can be oriented in different directions to produce a broadened illumination.

Figure 4:
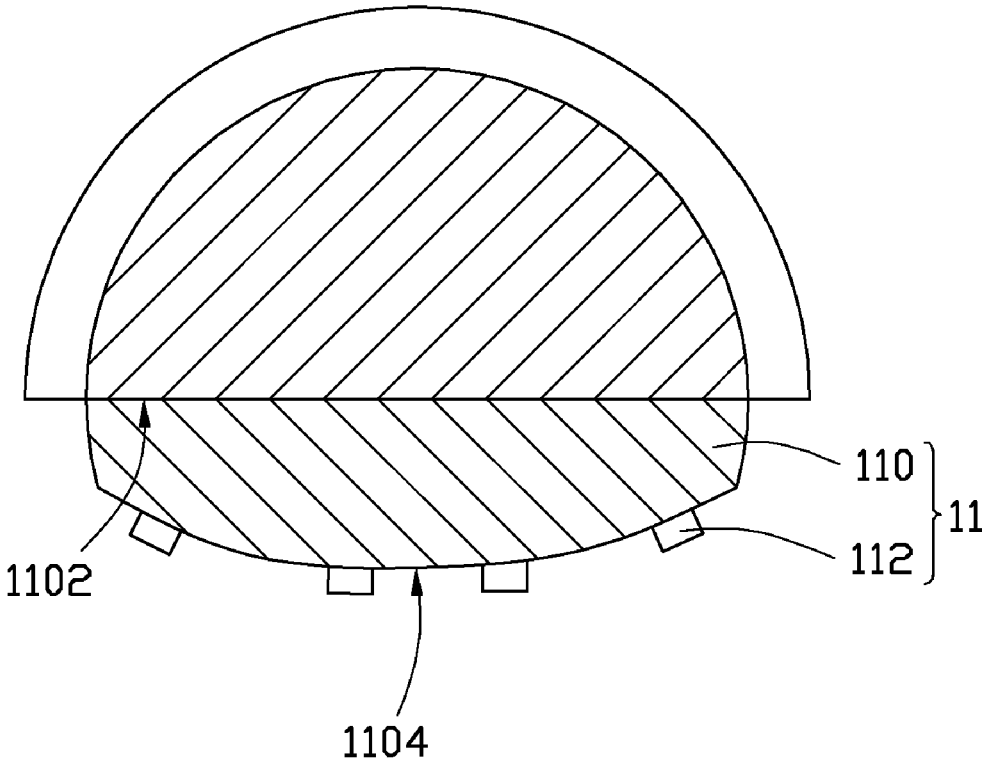
FIG. 4 shows a cross section of an LED lamp in accordance with a third embodiment of the disclosure.

Referring to FIG. 4 also, an LED lamp of a third embodiment is shown. Difference between the LED lamps of the first and third embodiments is still in the profile of the second engaging face 1104 of the printed circuit board 110. In the third embodiment of this disclosure, the second engaging face 1104 is a curved face protruding outwardly, whereby light emitted by the LEDs 112 which are mounted on the second engaging face 1104 can also be oriented in different directions.

Figure 5:
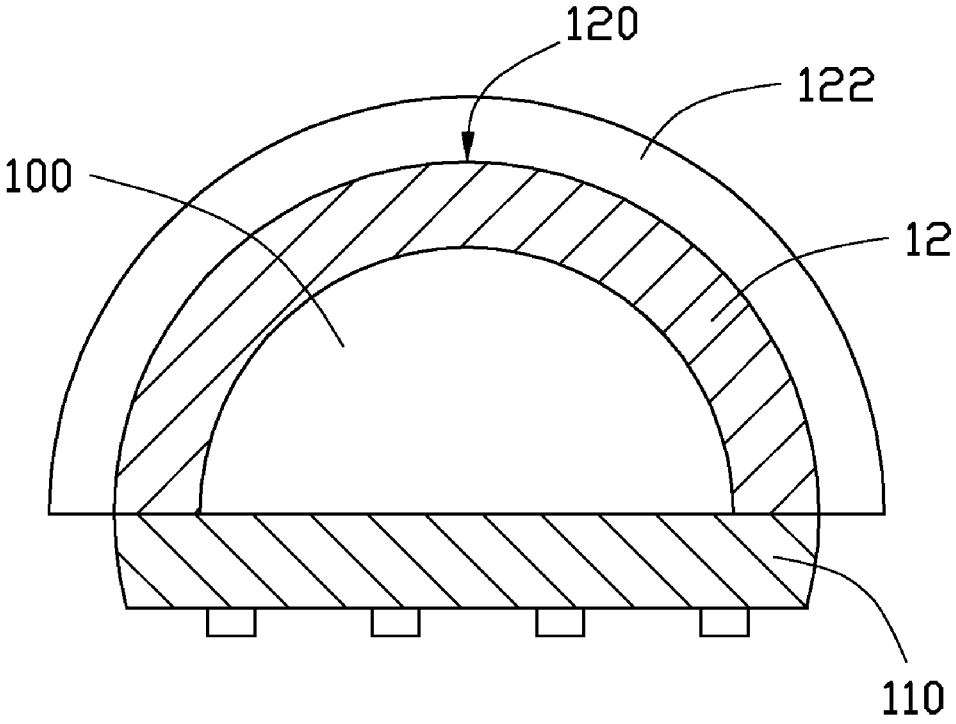
FIG. 5 shows a cross section of an LED lamp in accordance with a forth embodiment of the disclosure.

Referring to FIG. 5 also, an LED lamp of a forth embodiment is shown. Difference between the LED lamps of the first and forth embodiments is the configuration of the base 12 of the heat sink 10. In the forth embodiment of this disclosure, a center of the first face 121 is recessed inwardly, whereby the base 12 has an arced configuration. The base 12 cooperates with the printed circuit board 110 to form a tubular structure, wherein a through hole 100 is defined between the base 12 and the printed circuit board 110 of the LED module 11.

Figure 6:
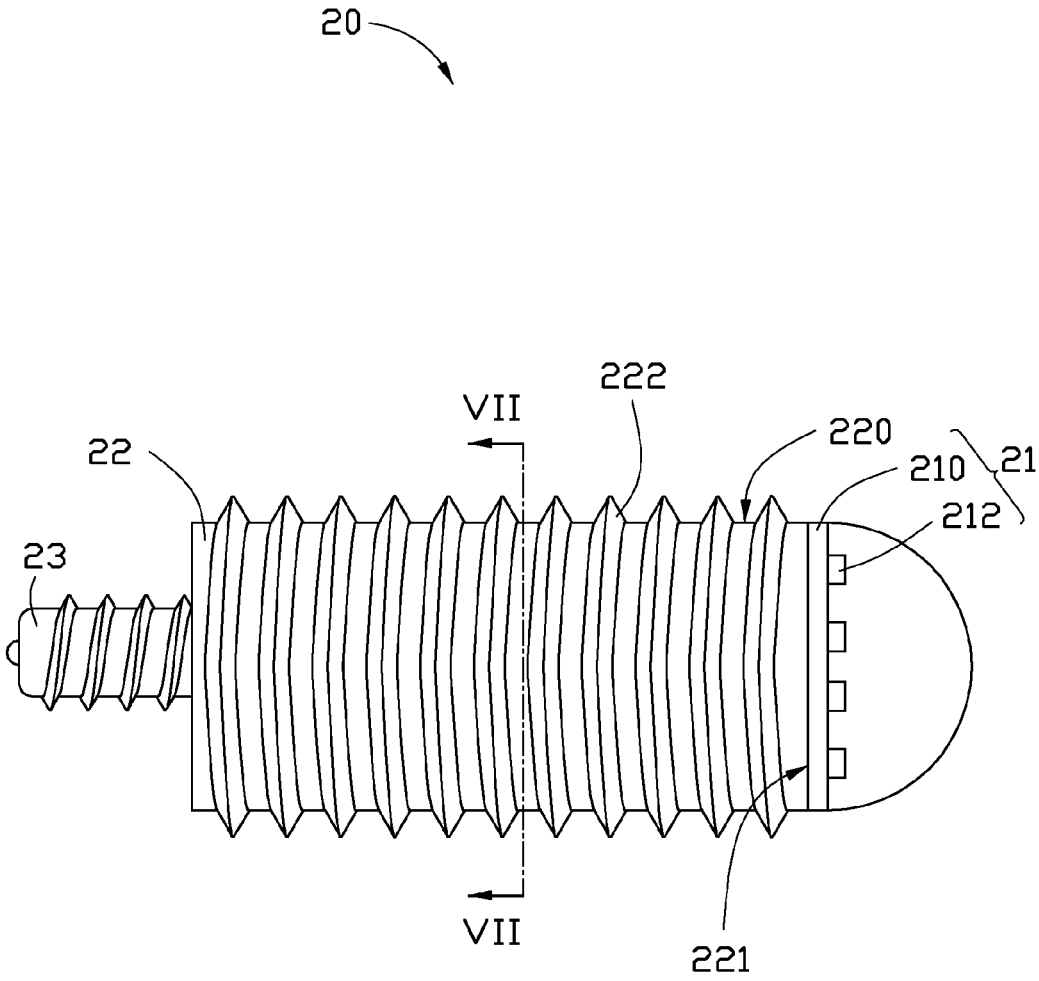
FIG. 6 is an elevation view of an LED lamp in accordance with a fifth embodiment of the disclosure.
Figure 7:
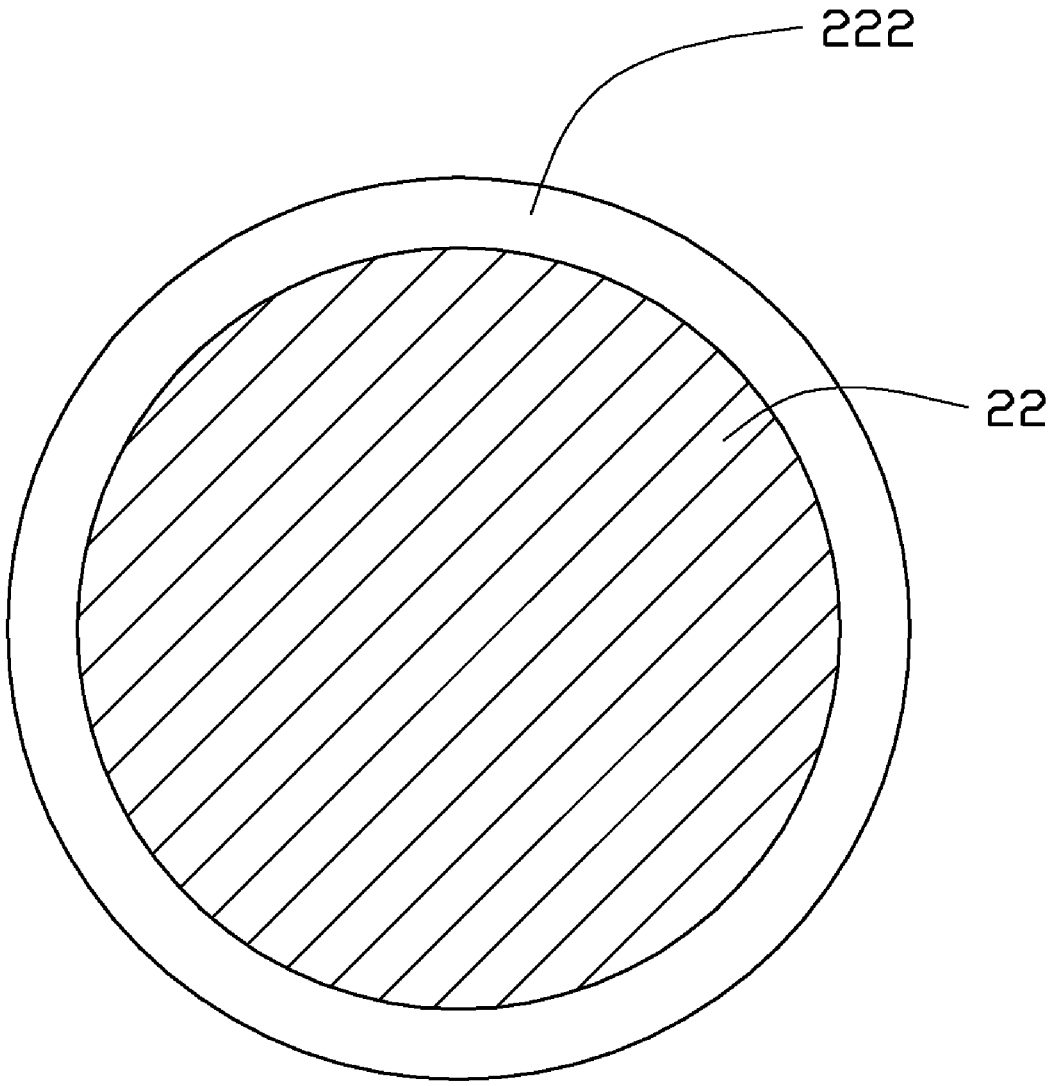
FIG. 7 is a cross-sectional view of the LED lamp of FIG. 6, taken along line VII-VII thereof.

Referring to FIGS. 6 and 7, an LED lamp of a fifth embodiment is shown, which includes a heat sink 20. Difference between the LED lamps of the first and fifth embodiments is the configurations of the heat sinks 10, 20. In the fifth embodiment of this disclosure, the heat sink 20 comprises a columnar base 22 and a plurality of fins 222 extending outwardly from an outer circumference of the base 22. The fins 222 extend spirally relative to an axis of the base 22. The base 22 defines a first engaging face 221 at an end thereof and a second engaging face 220 at the outer circumference thereof, wherein the first engaging face 221 is planar and the second engaging face 220 is a circular face. The fins 222 are arranged on the second engaging face 220. An LED module 21 is thermally attached to the first engaging face 221, and comprises a printed circuit board 210 and a plurality of LEDs 212 mounted on the printed circuit board 210. A connecter 23 extends outwardly from an opposite end of the base 22 of the heat sink 20 for electrically connecting the LED module 21 to a power supply. The connecter 23 is threadedly engaged with the power supply by a plurality of threads formed on an outer circumference of the connecter 23. A pitch of the threads of the connecter 23 is equal to that of the fins 222 of the heat sink 20.

Figure 8:
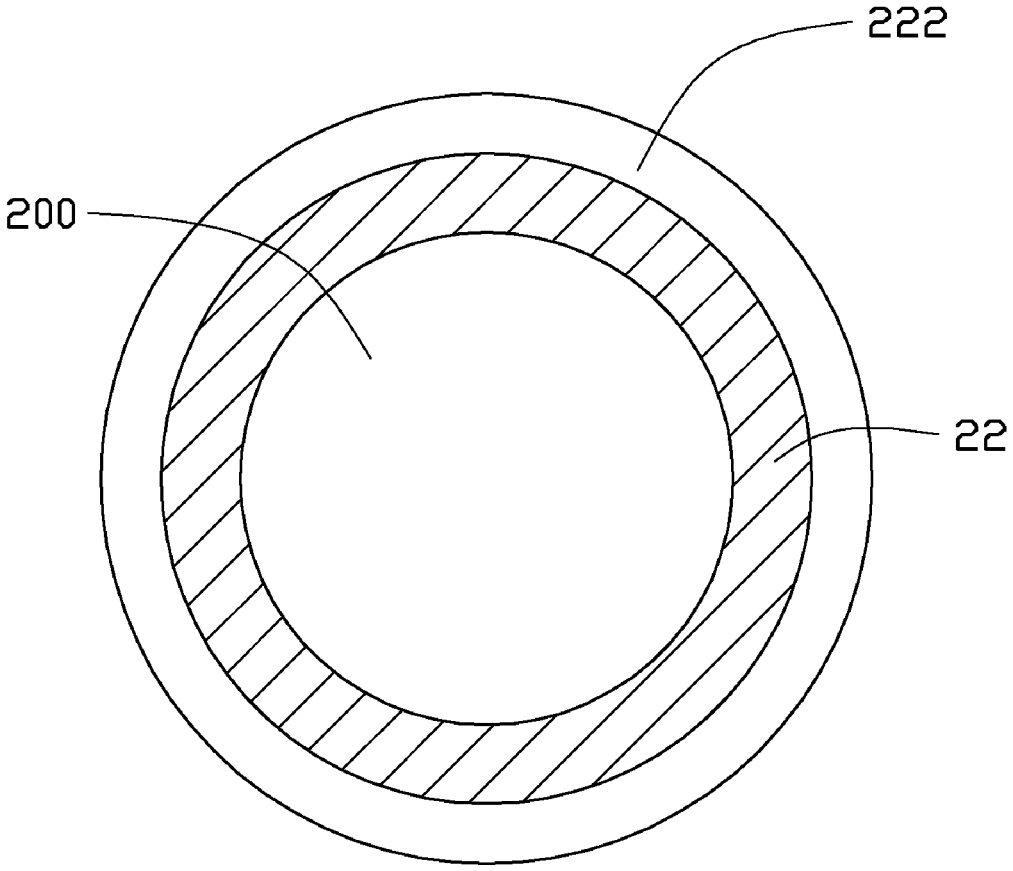
FIG. 8 shows a cross section of an LED lamp in accordance with a sixth embodiment of the disclosure.

Referring to FIG. 8, an LED lamp of a sixth embodiment is shown. Difference between the LED lamps of the fifth and sixth embodiments is the configuration of the heat sink 20. In the sixth embodiment of this disclosure, the base 22 of the heat sink 20 is tubular and defines a through hole 200 extending through two opposite ends of the base 22.

Figure 9:
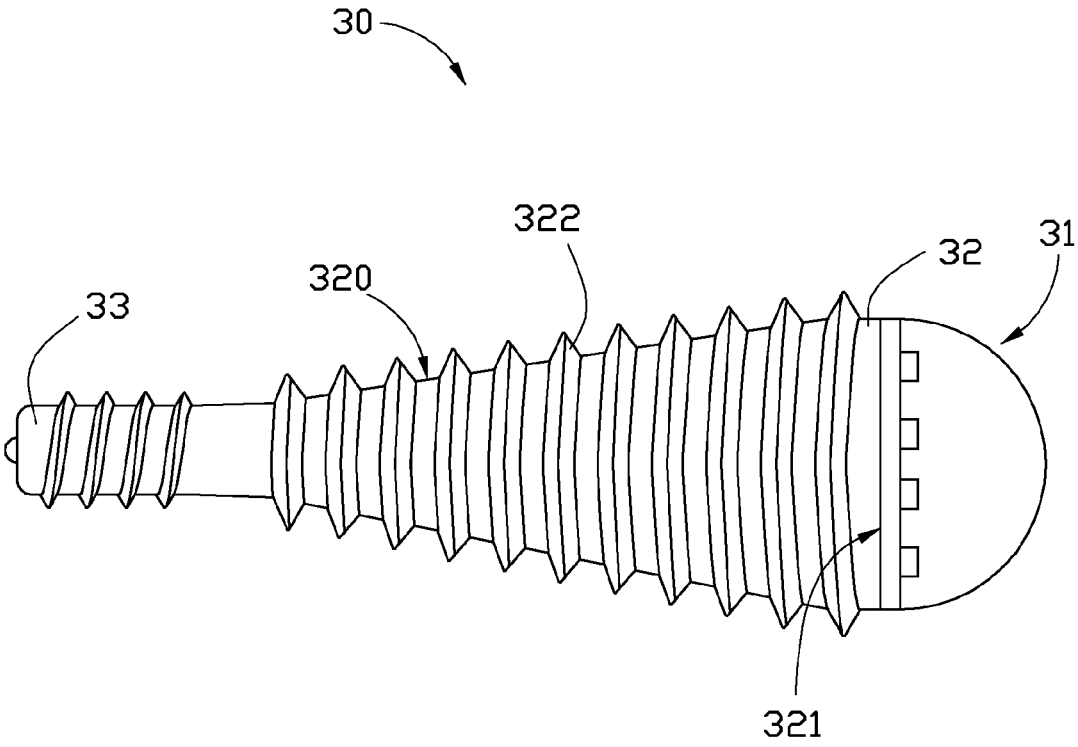
FIG. 9 is an elevation view of an LED lamp in accordance with a seventh embodiment of the disclosure.

Referring to FIG. 9, an LED lamp of a seventh embodiment is shown, which includes a heat sink 30. Difference between the LED lamps of the fifth and seventh embodiments is the configurations of the heat sinks 20, 30. In the seventh embodiment of this disclosure, the heat sink 30 comprises a base 32 having a configuration like a cone and a plurality of fins 322 extending outwardly from an outer circumference of the base 32. The fins 322 extend spirally relative to an axis of the base 32. The base 32 defines a first engaging face 321 at an end thereof and a second engaging face 320 at the outer circumference thereof, wherein the first engaging face 321 is planar and the second engaging face 320 is circular and tapered. The fins 322 are arranged on the second engaging face 320. An LED module 31 is thermally attached to the first engaging face 321. A connecter 33 extends outwardly from an opposite end of the base 32 of the heat sink 30 for electrically connecting the LED module 31 to a power supply. The connecter 33 is threadedly engaged with the power supply by a plurality of threads formed on an outer circumference of the connecter 33.

Figure 10:
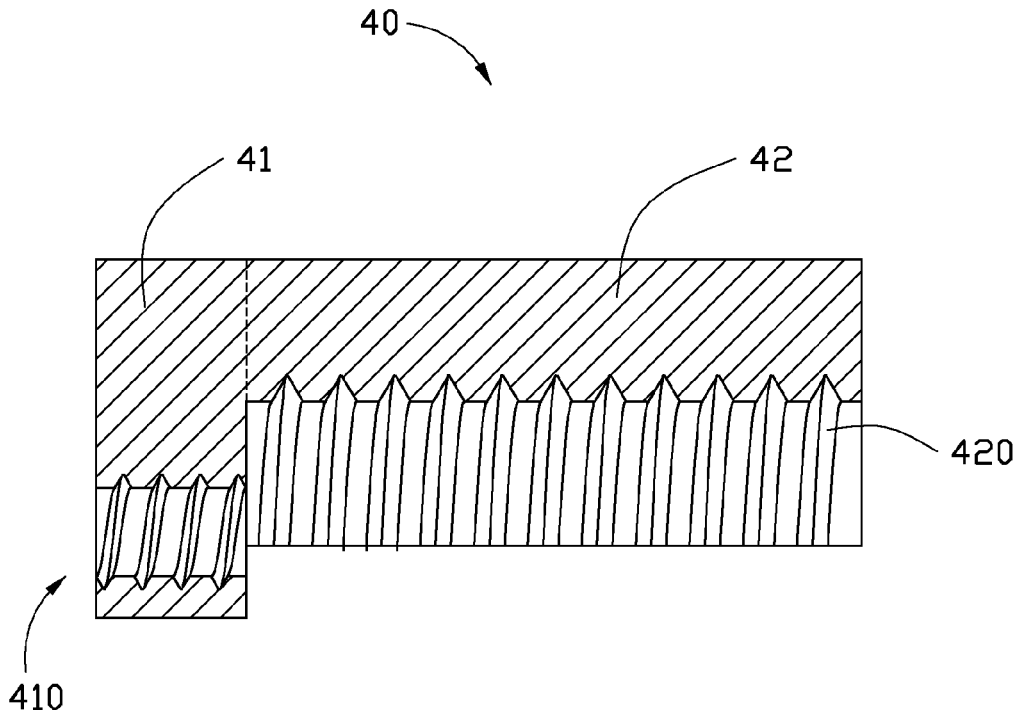
FIG. 10 shows a cross section of a lamp support for the LED lamp of the first through forth embodiments.

Referring to FIG. 10, a lamp support 40 is further provided to engage with the LED lamp of the first through forth embodiments. The lamp support 40 comprises a main body 41 and an engaging body 42 extending outwardly from the main body 41. A mounting hole 410 is defined in the main body 41. A plurality of threads are defined in the mounting hole 410. The engaging body 42 has an arced configuration and defines a curved inner face (not labeled) recessed inwardly. A plurality of engaging threads 420 are defined in the inner face of the engaging body 42. When the LED lamp is assembled to the lamp support 40, the connecter 13 is threadedly inserted into the mounting hole 410 of the main body 41, and the fins 122 of the heat sink 10 are threadedly engaged with the engaging threads 420 of the engaging body 42. The main body 41 is electrically isolated from the engaging body 42. The main body 41 may be a socket for electrical connection with the connecter 13 of the LED lamp.

Figure 11:
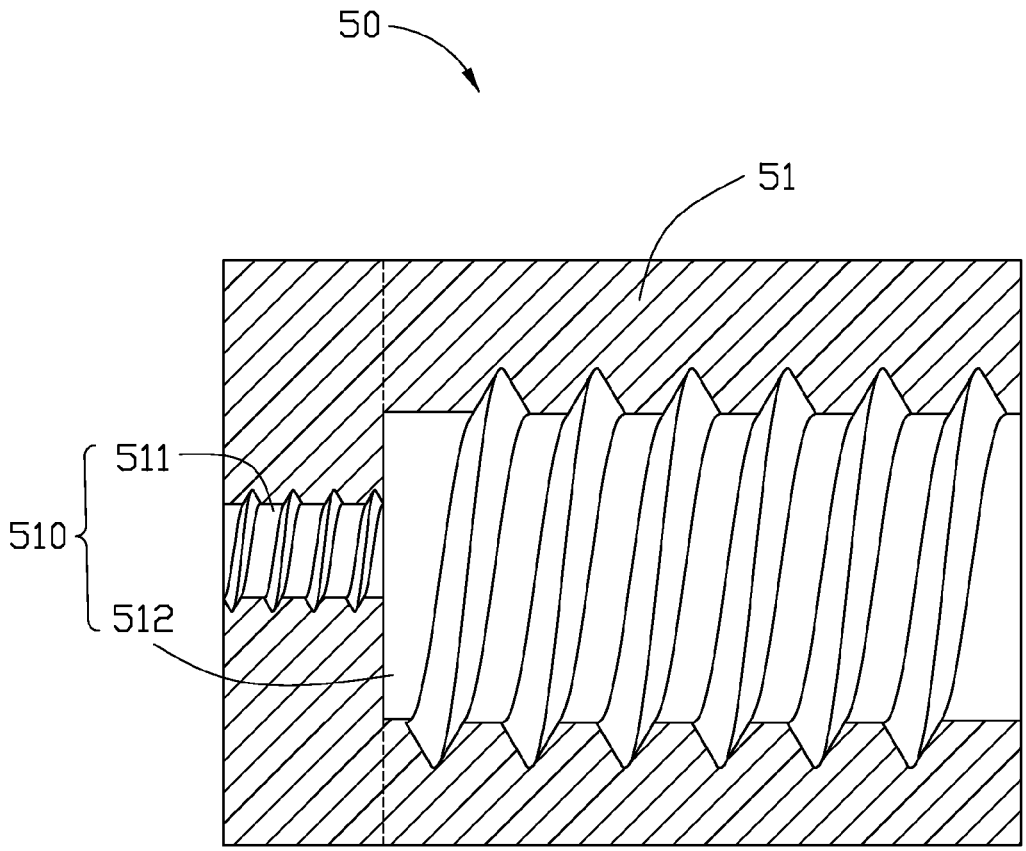
FIG. 11 shows a cross section of a lamp support for the LED lamp of fifth and sixth embodiments.

Referring to FIG. 11, a lamp support 50 is further provided to engage with the LED lamp of the fifth and sixth embodiments. The lamp support 50 comprises a columnar main body 51. A mounting hole 510 is defined in the main body 51 for receiving the LED lamp correspondingly. The mounting hole 510 consists of a first portion 511 and a second portion 512 communicating with the first portion 511. A diameter of the first portion 511 is less than that of the second portion 512. A plurality of threads are defined in the mounting hole 510. When the LED lamp is assembled to the lamp support 50, the connecter 23 is threadedly inserted into the first portion 511 of the mounting hole 510, and the heat sink 20 is threadedly inserted into the second portion 512 of the mounting hole 510. Although not being clearly shown in FIG. 11, a portion of the main body 51 corresponding to the first portion 511 of the mounting hole 510 is electrically isolated from another portion of the main body 51 corresponding to the second portion 512 of the mounting hole 510. The portion of the main body 51 corresponding to the first portion 511 of the mounting hole 510 may be a socket for providing power to the connecter 23 of the LED lamp.

The lamp supports 40, 50 are both made from heat-conducting materials for facilitating heat dissipation from the heat sinks 10, 20 of the LED lamps. The lamp supports 40, 50 can be enclosures of illumination devices and the LED lamps can be light sources of the illumination devices. Being threadedly engaged with the supports 40, 50, the light sources, i.e., the LED lamps, can be conveniently assembled/disassembled from the enclosures of the illumination devices, thereby facilitating replacement of the light sources of the illumination devices. Furthermore, the engagement between the threads of the heat sinks 10, 20 and the lamp supports 40, 50 is intimate enough to achieve a good heat conduction therebetween, thereby improving heat dissipation of the illumination devices.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a heat sink comprising a base having a heat-dissipating face and a plurality of spiral fins protruding outwardly from the heat-dissipating face of the base;

an LED module comprising a printed circuit board mounted on the base and a plurality of LEDs disposed on the printed circuit board;

a connecter electrically connecting the LED module to a power supply; and a lamp support comprising a main body and an engaging body, the engaging body extending outwardly from the main body and electrically isolated from the main body, a mounting hole being defined in the main body and a plurality of threads being defined in the mounting hole, a plurality of engaging threads being defined in an inner face of the engaging body, the connecter being threadedly inserted in the mounting hole, the fins of the heat sink being threadedly engaged with the engaging threads of the engaging body.

2. The LED lamp as described in claim 1, wherein the printed circuit board is plate-shaped and defines a planar first engaging face and a planar second engaging face opposite to the first engaging face, and the first engaging face is attached to the base, and the LEDs are mounted on the second engaging face.

3. The LED lamp as described in claim 1, wherein the printed circuit board comprises a flat first engaging face attached to the base and a curved second engaging face opposite to the first engaging face.

4. The LED lamp as described in claim 3, wherein the second engaging face is protruded outwardly and the LEDs are mounted on the second engaging face.

5. The LED lamp as described in claim 1, wherein the printed circuit board has a configuration like a prism and defines a first engaging face attached to the base and a plurality of second engaging faces on which the LEDs mounted.

6. The LED lamp as described in claim 5, wherein the second engaging faces are inclined to each other.

7. The LED lamp as described in claim 1, wherein the base has a semicircular cross section and defines a planar first face and a curved second face at an outer circumference thereof, the first face is attached to the printed circuit board, and the fins are arranged on the second face.

8. The LED lamp as described in claim 7, wherein the connecter extends from an end of the base.

9. The LED lamp as described in claim 1, wherein the base is arc-shaped and cooperates with the printed circuit board to form a tubular structure.

10. The LED lamp as described in claim 1, wherein the base is columnar and defines a curved first face at an outer circumference thereof, the fins are arranged on the first face, and the printed circuit board is attached to an end of the base.

11. The LED lamp as described in claim 10, wherein the connecter extends from an opposite end of the base.

12. The LED lamp as described in claim 1, wherein the base is cone-shaped and defines a curved first face at an outer circumference thereof, the fins are arranged on the first face, and the printed circuit board is attached to an end of the base.

13. The LED lamp as described in claim 12, wherein the connecter extends from an opposite end of the base.

14. The LED lamp as described in claim 1, wherein the base is tubular and defines a curved first face at an outer circumference thereof, the fins are arranged on the first face, and the printed circuit board is attached to an end of the base.

15. The LED lamp as described in claim 1, wherein the connecter defines a plurality of threads at a periphery thereof.

16. The LED lamp as described in claim 15, wherein a pitch of the threads of the connecter is equal to that of the fins of the heat sink.

* * * * *